US009478911B2

(12) United States Patent
Friesen

(10) Patent No.: US 9,478,911 B2
(45) Date of Patent: Oct. 25, 2016

(54) LOCKING MECHANISM FOR PLUG-IN CONNECTORS

(71) Applicant: Harting Electronics GmbH, Espelkamp (DE)

(72) Inventor: Heinrich Friesen, Minden (DE)

(73) Assignee: HARTING ELECTRONICS GMBH, Espelkamp (DE)

( * ) Notice: Subject to any disclaimer, the term of this patent is extended or adjusted under 35 U.S.C. 154(b) by 0 days.

(21) Appl. No.: 14/442,882

(22) PCT Filed: Nov. 26, 2013

(86) PCT No.: PCT/DE2013/100397

§ 371 (c)(1),
(2) Date: May 14, 2015

(87) PCT Pub. No.: WO2014/079418

PCT Pub. Date: May 30, 2014

(65) Prior Publication Data

US 2015/0303620 A1 Oct. 22, 2015

(30) Foreign Application Priority Data

Nov. 26, 2012 (DE) ..... 10 2012 111 408

(51) Int. Cl.
*H01R 4/50* (2006.01)
*H01R 13/639* (2006.01)
*H01R 13/627* (2006.01)

(52) U.S. Cl.
CPC ..... *H01R 13/639* (2013.01); *H01R 13/627* (2013.01)

(58) Field of Classification Search
CPC ..... H01R 13/639; H01R 13/627; H01R 13/6275; H01R 13/6584; H01R 13/5804
USPC ..... 439/345
See application file for complete search history.

(56) References Cited

U.S. PATENT DOCUMENTS

| | | | | |
|---|---|---|---|---|
| 7,131,854 | B1 | 11/2006 | Pavlovic et al. | |
| 7,134,914 | B1 * | 11/2006 | Wu | H01R 13/5804 439/357 |
| 7,186,134 | B2 * | 3/2007 | Togami | H01R 13/6275 439/160 |
| 7,226,307 | B1 * | 6/2007 | Chen | H01R 13/6275 439/352 |
| 7,445,484 | B2 * | 11/2008 | Wu | H01R 13/6584 439/352 |
| 7,572,138 | B1 * | 8/2009 | Wu | H01R 13/6275 439/352 |
| 7,666,023 | B2 * | 2/2010 | Wu | H01R 13/6275 439/352 |

(Continued)

FOREIGN PATENT DOCUMENTS

| | | |
|---|---|---|
| DE | 10236275 | 1/2004 |
| DE | 69822740 | 2/2005 |

(Continued)

*Primary Examiner* — Jean F Duverne
(74) *Attorney, Agent, or Firm* — Jacobson Holman, PLLC.

(57) ABSTRACT

The invention relates to a locking mechanism for plug-in connectors with a mating connector. Such a locking mechanism has two types of locking means, a primary locking element that is suitable for locking the mating connector and a secondary locking element that is suitable for mutually locking with the primary locking element. In doing so, the secondary locking element locks the primary one in the locked state of the locking mechanism and the primary locking element locks the secondary one in the unlocked state. By contacting the mating connector, the mechanism is automatically locked and is unlocked by actuating the secondary locking element which is implemented as an actuator.

21 Claims, 4 Drawing Sheets

(56) References Cited

U.S. PATENT DOCUMENTS

| | | | | |
|---|---|---|---|---|
| 2003/0049000 | A1* | 3/2003 | Wu | G02B 6/4292 385/92 |
| 2005/0196109 | A1* | 9/2005 | Kim | G02B 6/4292 385/92 |
| 2006/0014413 | A1 | 1/2006 | Annecke | |
| 2010/0194119 | A1 | 8/2010 | Ishigami et al. | |

FOREIGN PATENT DOCUMENTS

| | | |
|---|---|---|
| DE | 102004034321 | 1/2006 |
| DE | 102006039916 | 3/2007 |
| DE | 102005058969 | 6/2007 |
| DE | 102006040254 | 3/2008 |
| EP | 0902506 | 3/1999 |
| EP | 1337008 | 8/2003 |
| EP | 1540778 | 6/2005 |

* cited by examiner

LOCKING MECHANISM FOR PLUG-IN CONNECTORS

The invention relates to a locking mechanism for locking a plug-in connector with a mating connector.

Such locking mechanisms are needed in order to achieve a secure mechanical, non-permanent connection of the plug-in connector with the mating connector. To this end it has to be ensured that in the contacted state, both plug-in connectors are mechanically completely latched together and also that the internal contacts are completely connected.

The category of plug-in connectors may relate to both electrical and optical, pneumatic or hydraulic plug-in connectors. Such locking mechanisms may be applied to any desired type of plug-in connectors.

Apart from the mechanical connection of the plug-in connectors, also the release of the connection has to be ensured. To this end, the mechanical latching has to be completely released, without in doing so destroying components of the locking mechanism or of the plug-in connectors.

It has to be possible for these contacting and contact release operations of plug-in connectors and locking mechanisms to be repeated many times without compromising the quality of the lock or of the contact.

PRIOR ART

DE10236275B3 shows a locking device for two plug-in connectors that can be joined together, wherein latching hooks on one of the plug-in connectors engage in latching recesses of the second plug-in connector as the plug-in connectors are joined together. The latching hooks may be lifted and removed out of the latching indentations by means of a sliding sleeve and chamfers integrally moulded therein, so that the plug-in connectors can be separated.

From DE102006040254A1, a circular plug-in connector having two coupling portions is known, wherein latching cams of the first coupling portion engage in grooves of the second coupling portion. In this process, the latching cams are pushed into the grooves by means of an actuation slider. By withdrawing the actuation sliders, the latching cams can slide out of the grooves if an appropriate tensile force is applied to the two coupling portions.

A disadvantageous effect of the solutions known from the prior art is that a force constantly acts onto the latching means of the plug-in connectors. Moreover, this force increases, as a result of the direction of actuation of the actuation slider and of the sliding sleeve, when the latching is released. As a result, the tensile force acting on the latching means continuously increases during the unlocking process, until the latching means are released.

The increase in tensile force leads to the occurrence of a very large force in the edge area of the latching means as the latching means are released from each other. This greatly increased force leads, in the case of frequent unlocking actions of the plug-in connectors, to rapid wear and tear of the latching means.

Another negative effect of the devices known from the prior art is that a complete latching of the plug-in connectors cannot always be ensured. In the case of very great plug-in and/or contacting forces of the internal contacts of the plug-in connectors, incomplete latching as a result of the high friction of the latching means may be caused. An additional check has to be made to determine whether the latching is complete.

OBJECT OF THE INVENTION

It is the object of the invention to provide a locking mechanism for plug-in connectors, which ensures a complete latching and indicates this to the user in a clear manner. Moreover, the locking mechanism should be suitable for a large number of plug-in cycles, without there being any risk of wear and tear, above all on the latching means.

This object is achieved by means of the features of Independent claim 1.

Advantageous embodiments of the invention are indicated in the dependent claims.

The present invention proposes a locking mechanism for locking plug-in connectors with mating connectors. To this end, the locking mechanism has at least one locking means that is provided for an interlocking engagement of the mating connector in a locking recess.

In this context, the locking mechanism is advantageously provided on the plug-in connector. It merely needs to be possible to join the mating connector to the plug-in connector in a form-fitting manner and the mating connector must have a corresponding locking recess for the locking means.

The mating connector for the plug-in connector is preferably a plug-in counter-connector that can be connected to the plug-in connector. The mating connector may also be a plug-in receptacle that matches the plug-in connector and is attached or moulded to a housing or a device. Other corresponding components that can be contacted with a plug-in connector are to be understood to be equivalent to a mating connector.

The terms plug-in connector and mating connector may optionally be interchanged and replaced. This has no bearing on the functioning mode of the proposed locking mechanism. In this case, the locking mechanism would be located on the mating connector and would be locked onto the plug-in connector to be contacted.

According to the invention it is advantageous here if both the locking means of the locking mechanism and the locking recess, which matches the former in a form-fitting manner, have rounded shapes. As a result, advantageously any great forces on the tips of latching hooks, as known from the prior art, are avoided during locking and unlocking.

The locking means are provided on a primary locking element that allows an engagement of the mating connector in the locking recess as well as the release thereof.

In an advantageous embodiment of the Invention, the primary locking element is implemented as a rocker-type component which is rotationally supported in a base body of the locking mechanism via an Integral rotary axis. In this way, the mating connector can be locked or released by tilting the primary locking element.

Since due to the rounded shape of the locking means and the locking recess on the mating connector the lock would release itself as soon as opposite forces were to act on the plug-in connector and the mating connector, an additional secondary locking element is provided.

The secondary locking element is provided for locking the primary locking element in that state thereof in which it locks the mating connector. To this end, the secondary locking element advantageously includes a blocking means that is located in the movement path of the primary locking element in such a way that it cannot release the mating connector.

By moving the secondary locking element—advantageously in the direction opposite to the plug-in direction of the plug-in connector—the blocking means may be moved out of the movement path of the primary locking element. The counter-connector can now again be released by the primary locking element.

In an advantageous embodiment, a spring element is provided which acts on the secondary locking element. According to the invention, this spring element is designed in such a way that it effects a forced movement of the secondary locking element into the position in which the primary locking element is locked. In this way, a forced locking of the primary locking element is ensured, when the latter locks the mating connector.

According to the invention, a further spring element is provided which acts on the primary locking element. This spring element is designed in such a way that it effects a forced movement of the primary locking element into the position in which the mating connector is released. The purpose of this forced movement, which obviously opposes the actual purpose of locking, is a secure unlocking the locking mechanism.

Advantageously, the secondary locking element is at the same time formed as an actuator, so that it can be actuated by hand. By sliding the secondary locking element against the forced movement, the primary locking element is released. The primary locking element is again moved as a result of the forced movement thereof into the position in which the mating connector is released, and releases the locking of the plug-in connector and the mating connector.

According to the invention, the locking elements are designed in such a way that, as has already been mentioned, the secondary locking element blocks the primary locking element in the position in which the mating partner is blocked. Moreover, in a position in which the mating connector is released, the primary locking element blocks the secondary locking element.

For unlocking the locking mechanism, the secondary locking element has to be moved by hand, advantageously in the direction opposite to the plug-in direction, in order to release the primary locking element. As a result of the acting spring force, the primary locking element is automatically placed in an unlocking position.

In order to lock the locking mechanism, the primary locking element needs to be moved again from the unlocked into a locking position. In the locked state, the secondary locking element is, as a result of the acting spring force, automatically placed in the position in which the primary locking element is locked.

According to the invention, the locking of the primary locking element is initiated by the mating connector itself. To this end, the primary locking element has a lever region. The lever region is located, in the unlocked condition, in the plug-in region of the mating connector. By contacting the mating connector, the latter cooperates with the lever region and exerts a force on the primary locking element. In this way, the contacting force of the mating connector effects a movement of the primary locking element into a position in which the mating connector is locked.

Further advantageous embodiments of the invention are shown in the dependent claims and in the embodiment example.

EMBODIMENT EXAMPLE

An embodiment example of the invention is shown in the drawings and will be explained in more detail below, wherein.

Figure 1:
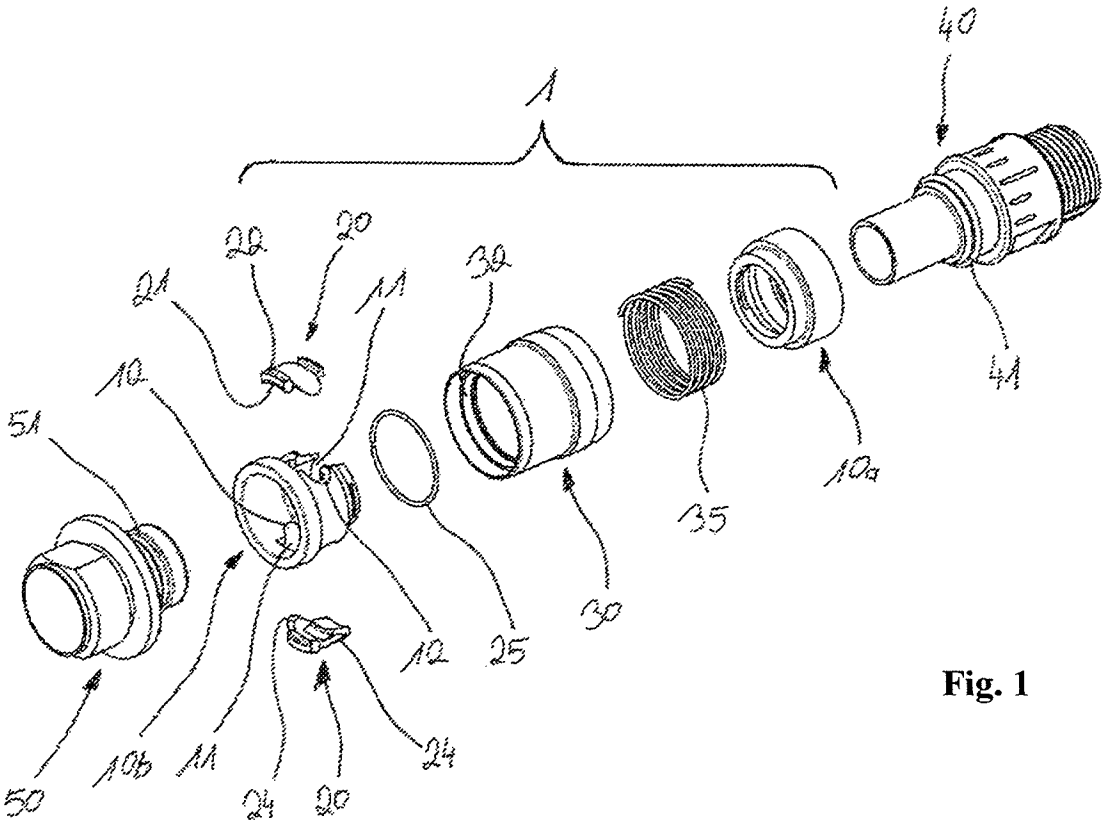
FIG. 1 shows a perspective exploded view of a locking mechanism according to the invention with a plug-in connector and a mating connector.

FIG. 1 shows a locking mechanism 1 according to the invention in a three-dimensional exploded view. Moreover, a plug-in connector 40 is shown on which the locking mechanism 1 can in this embodiment be fastened by means of a snap ring 41. On the opposite side, a mating connector 50 is shown which is provided for contacting and locking with the plug-in connector.

The embodiment of the invention as shown in the figures is based on a circular plug-in connector. This embodiment is merely intended for illustration and is not to be construed as limiting the invention. The invention can also be applied to other, non-circular plug-in connector types.

The locking mechanism 1 is formed from a base body 10 which is designed to be connected to the plug-in connector 40. In this embodiment, the base body 10 has a corresponding recess on the inside thereof, so that it can be fixed to the plug-in connector by means of the snap ring 41.

In this particular embodiment, the base body 10 is made from two parts 10*a* and 10*b*. This is merely done for assembly-related reasons so as to be able to assemble the locking mechanism 1. Depending on the particular embodiment, single-part or multi-part base bodies 10 are conceivable.

Depending on the embodiment, the base body parts 10*a* and 10*b* are here provided with latching means used for connecting the parts 10*a* and 10*b* to form a base body 10. The base body parts 10*a* and 10*b* will not be explained in any more detail because, as has already been mentioned, they may differ depending on the embodiment and the assembly conditions. Further, the base body parts 10*a* and 10*b* will not be considered any further and will only be referred to as base bodies 10.

The base body 10 is, due to the circular plug-in connectors 40 and 50, implemented as a cylindrical sleeve that is provided on the plug-in connector 40. According to the invention, it has—here two—recesses 11 that are located on opposite sides of the sleeve-type base body 10. The recesses 11 are provided for receiving a primary locking element 20 each.

The recesses 11 each have laterally two receptacles 12. The part-circular recesses 12 form an axle support in which the primary locking elements 20 can be rotationally supported.

The—here two—primary locking elements 20 are designed as rockers and have a shape that corresponds to that of the recesses 11 of the base body 10. They have mouldings that serve as a rotary axis 24 and are provided for being received in the receptacles 12. As a result of the again part-circular formation of the rotary axis 24, the primary locking elements 20 can slide in the receptacles 12.

As a result, a rocker-type rotary movement of the primary locking elements 20 in the recesses 11 is possible.

Further, a spring element 25 is provided, which is received in a groove-shaped spring receptacle 15 in the base body 10. The spring receptacle 15 expediently intersects the recesses 11 for the primary locking elements 20. As a result, the spring element 25 in the spring receptacle 15, which is formed as an annular spring, can act on the primary locking elements 20.

To this end, the primary locking elements 20 have a spring receptacle 23 which in the mounted condition is located in the area of the spring receptacle 15 of the base body 10. According to the invention, the spring element 25 can thus, in the area of the spring receptacles 23, exert a radially inwardly directed force onto the primary locking elements 20.

The locking mechanism 1 is completed by a secondary locking element 30 that is shaped like a sleeve, wherein the remaining elements of the locking mechanism 1 are provided on the inside thereof. The secondary locking element 30 is provided axially along the plug-in direction in a manner so as to be movable on the base body 10.

On the inside, the secondary locking element 30 has an circumferential moulding that is used as a blocking means 32.

A further provided spring element 35 is here designed as a coil spring and is provided between the base body 10 and the secondary locking element 30. It generates a force between a spring stop 16 provided on the base body 10 and the blocking means 32 that serves as the spring stop in the secondary locking element 30. As a result, the secondary locking element 30 is subjected to a forced movement in the plug-in direction of the plug-in connector 40.

Figure 2:
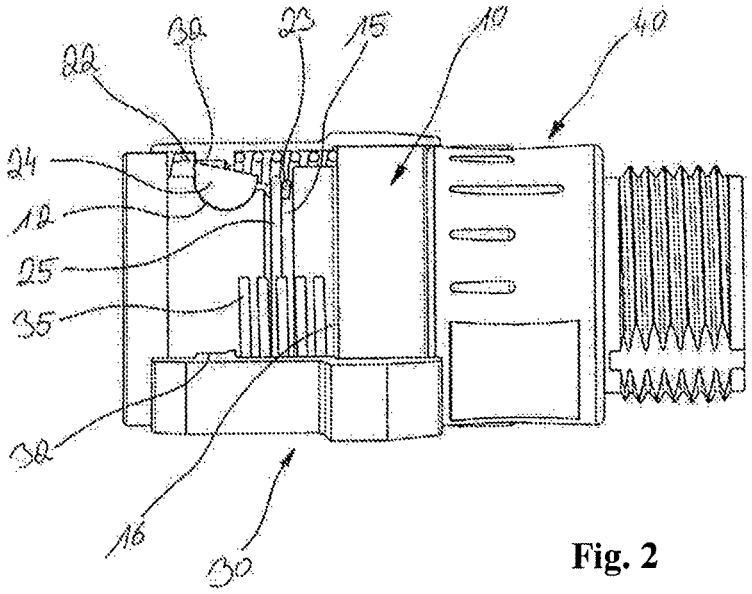
FIG. 2 shows the locking mechanism according to the invention in a partially sectioned view.

The assembled locking mechanism 1 is shown in a partial section in FIG. 2.

What can be seen is a primary locking element 20 that is supported in the base body 10 so as to be rotatable about its rotary axis 24. The spring element 25 inserted into the spring receptacle 15 thus acts on the spring receptacle 23 of the primary locking element 20 in such a way that the spring receptacle 23 is pressed a radially inwards. As a result, a blocking means 22 provided on the locking element 20 is in turn pressed radially outwards.

In this position, the blocking means 22 is located in the movement path of the blocking means 32. The blocking means 32 is pressed by the spring element 35 against the blocking means 22 in the plug-in direction and is blocked thereby. The various states of the locking mechanism 1 are shown and described in detail in FIGS. 3 to 6.

Figure 3:
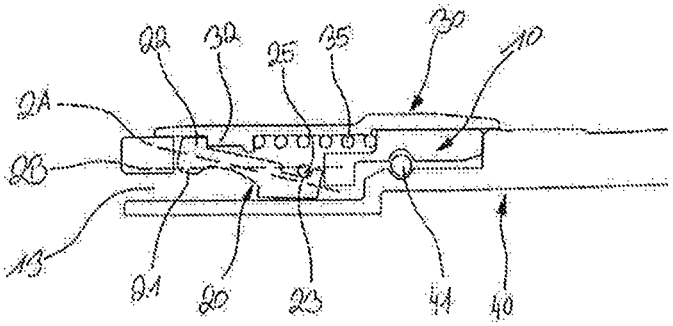
FIG. 3 shows a section through a locking mechanism in an opened state.
Figure 4:
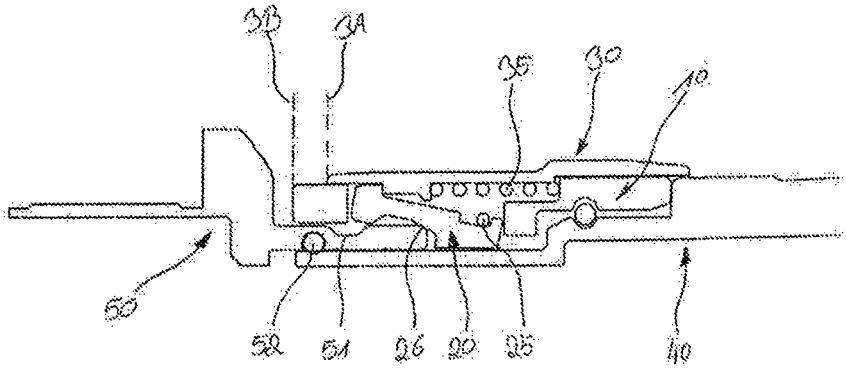
FIG. 4 shows a section as in FIG. 3 with a mating connector in a partially contacted state.
Figure 5:
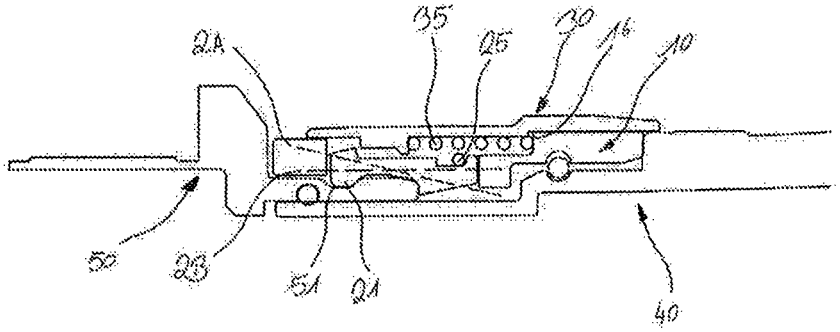
FIG. 5 shows a section as in FIG. 4 in a fully contacted, closed, non-locked state.
Figure 6:
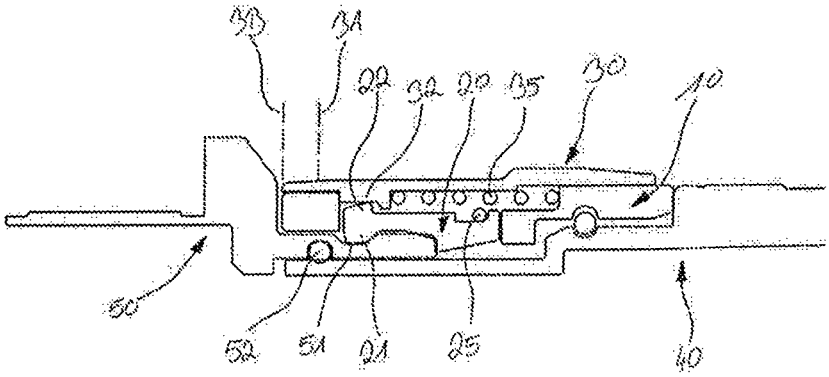
FIG. 6 shows a sectional view through the locking mechanism in the fully contacted and locked state.

FIGS. 3 to 6 respectively show here a section through a locking mechanism 1 according to the invention during the contacting and locking process in the following states:

FIG. 3 shows an opened state without a mating connector 50,

FIG. 4 shows an opened state with a partially contacted mating connector 50, FIG. 5 shows a closed state with a fully contacted, unlocked mating connector 50, and FIG. 6 shows a closed state with a fully contacted and locked mating connector 50.

FIG. 3 shows the base body 10 that is retained on the plug-in connector 40 by means of the snap ring 41. The state of the locking mechanism 1 as shown here corresponds to the state shown in FIG. 2. The primary locking element 20 is retained in a first location 2A by the radially inwardly directed force (shown here at the bottom) exerted by the spring element 25.

In this location 2A, there is a locking means 21 integral with the primary locking element 20 outside of a plug-in region 13 of the mating connector 50. At the same time, the blocking means 22 is in the movement path of the blocking means 32. As a result, the movement of the secondary locking element 30 from the first position 3A shown here into a second position 3B (position 3A and position 3B are shown in FIG. 4) is prevented.

By virtue of the spring element 35, the secondary locking element 30 carries out a forced movement in the plug-in direction. To this end, the spring element 35 is clamped onto the base body 10 between the blocking means 32 and the spring receptacle 16.

FIG. 4 shows the locking mechanism 1 in the same state as in FIG. 3. In addition, the part of a mating connector 50 that is necessary for locking is shown. This is partially inserted into the plug-in region 13.

In this embodiment, a seal 52 is expediently provided on the mating connector 50, which is used for sealing the connection between the plug-in connector 40 and the mating connector 50.

In location 2A as shown, a lever region 26 on the primary locking element 20 protrudes into the plug-in area 13 of the mating connector. The front part of the mating connector 50 thus touches the lever region 26.

When the mating connector 50 is further, completely introduced into the plug-in area 13, a force is exerted on the lever region 26 and the primary locking element 20. As a result of this force, the primary locking element 20 is moved from the first location 2A into a second location 2B. In this process, the primary locking element 20 rotates about the rotary axis 24 against the spring force of the spring element 25.

Location 2B of the primary locking element 20 is shown in FIG. 5 with a completely inserted mating connector 50.

From FIG. 4 to FIG. 5, the primary locking element 20 has rotated against the force of the spring element 25 in an anticlockwise direction. As a result, the locking means 21 now engages in the plug-in region 13 and thus in the mating connector 50. To this end, a latching recess 51 is provided on the plug-in connector 50.

In this embodiment example, the latching recess 51 is expediently formed as a circumferential groove. As a result, the orientation of the mating connector 50 relative to the plug-in connector 40 and the locking mechanism 1 is variable. In other embodiments, for example in the case of square plug-in connectors, also another design of the latching recess 51, for example as a blind hole, is conceivable.

As a result of the rotation of the primary locking element 20 from location 2A to location 2B, also the blocking means 22 is moved out of the movement path of the blocking means 32. As a result, the spring element 35 can move the secondary locking element 30 from the first position 3A as shown in FIG. 5 into the second position 3B.

Position 3B of the secondary locking element 30 is shown in FIG. 6. This is, in the plug-in direction, in front of position 3A. What can be seen in FIG. 6 is that the blocking means 32 now blocks the blocking means 22 and is located in the movement path thereof. As a result, the locking of the mating connector 50 by the locking means 21 is ensured.

Since the primary locking element 20 is blocked in its movement by the secondary locking element 30, the mating connector 50 cannot be withdrawn from the locking mechanism 1 or from the plug-in connector 40.

In order to unlock the locking mechanism 1, the secondary locking element 30 would now have to be pulled in the direction opposite to the plug-in direction. As soon as the blocking means 32 releases the blocking means 22, the mating connector 50 can be released by a rotary movement of the primary locking element 20 in a clockwise direction.

Moreover, a rotation of the primary locking element 20, and the associated release of the mating connector 50, is supported by the spring force of the spring element 25.

LIST OF REFERENCE NUMERALS

1. Locking mechanism
10. Base body
11. Recess
12. Receptacle
13. Plug-in region
15. Spring receptacle
16. Spring stop
20. Primary locking element
2A First location of 20
2B Second location of 20
21. Locking means
22. Blocking means
23. Spring receptacle
24. Rotary axis
25. Spring element
26. Lever region
30. Secondary locking element
3A First position of 30
3B Second position of 30
32. Blocking means
35. Spring element
40. Plug-in connector
41. Snap ring
50. Mating connector
51. Latching recess
52. Seal

The invention claimed is:

1. A locking mechanism (1) for locking a plug-in connector (40) with a mating connector (50) to be contacted, wherein the locking mechanism (1) may be provided on the plug-in connector (40) and includes a base body (10) and at least two types of locking elements, wherein at least one primary locking element (20) of a first type is provided to be movable between a first location (2A) and a second location (2B), and wherein at least one secondary locking element (30) of a second type is provided to be movable between a first position (3A) and a second position (3B), wherein the locking mechanism (1) has a first, opened state in which the plug-in connector (40) and the mating connector (50) are not contacted, the primary locking element (20) is in the first location (2A) and the second locking element (30) is in the first position (3A), and has as well a second, closed state in which the plug-in connector (40) and the mating connector (50) are locked together, the primary locking element (20) is in the second location (2B) and the secondary locking element (30) is in the second position (3B), wherein the primary locking element (20) has a locking means (21) for engaging the contacted mating connector (50) when in the second location (2B) and for locking the plug-in connector (40) with the mating connector (50), and wherein the primary locking element (20) includes means for blocking, in the first location (2A), a movement of the secondary locking element (30) from the first position (3A) into the second position (3B), and the secondary locking element (30) includes means for blocking, in the second position (3B), a movement of the primary locking element (20) from the second location (2B) into the first location (2A), and wherein a primary spring element (25) is provided which exerts a force on the primary locking element (20) to move the primary locking element (20) into the first location (2A).

2. The locking mechanism (1) according to claim 1, characterised in that in the first location (2A), the locking means (21) of the primary locking element (20) releases the contacted mating connector (50).

3. The locking mechanism (1) according to claim 2, characterised in that the locking means (21) has a rounded shape and can engage in a latching recess (51) of the mating connector (50) to be contacted in a form-fitting manner.

4. The locking mechanism (1) according to claim 1, characterised in that the movement path of the secondary locking element (30) extends in the plug-in direction of the plug-in connector (40) and the first position (3A) is located, in the plug-in direction, behind the second position (3B).

5. The locking mechanism (1) according to claim 1, characterised in that the primary locking element blocking means (22) which, in the first location (2A) of the primary locking element (20), is located in the movement path of the secondary locking element (30) for blocking the secondary locking element.

6. The locking mechanism (1) according to claim 1, characterised in that the secondary locking element blocking means (32) which, in the second position (3B), is located in the movement path of the primary locking element (20) for blocking the primary locking element.

7. The locking mechanism (1) according to claim 1, characterised in that the primary locking element (20) is formed such that it can be moved by the mating connector (50) during contacting with the plug-in connector (40) from the first location (2A) to the second location (2B).

8. The locking mechanism (1) according to claim 7, characterised in that the primary locking element (20) has a lever region (26) which, in the first location (2A) of the primary locking element (20), protrudes into the plug-in region (13) of the mating connector (50) and, in the second location (2B) of the primary locking element (20), is located outside of the plug-in region (13) of the mating connector (50).

9. The locking mechanism (1) according to claim 8, characterised in that the lever region (26) is formed such that the lever region (26) and thus the primary locking element (20) can be moved by the contacting mating connector (50) from the first location (2A) into the second location (2B).

10. The locking mechanism (1) according to claim 1, characterised in that the base body (10) has at least one recess (11), in which the primary locking element (20) is received.

11. The locking mechanism (1) according to claim 10, characterised in that the recess (11) has a receptacle (12) in which the primary locking element (20) is rotationally supported between the first location (2A) and the second location (2B).

12. The locking mechanism (1) according to claim 1, characterised in that the primary locking element (20) is formed as a rocker and has a moulding that is suitable for acting as a rotary axis (24).

13. The locking mechanism (1) according to claim 12, characterised in that the primary locking element (20) is received on the rotary axis (24) so as to be rotational in the receptacle (12) of the base body (10).

14. The locking mechanism (1) according to claim 1, characterised in that the secondary locking element (30) is formed as a sleeve and surrounds the base body (10) and the primary locking element (20).

15. The locking mechanism (1) according to claim 1, characterised in that the secondary locking element (30) can be actuated by hand.

16. The locking mechanism (1) according to claim 1, characterised in that the locking mechanism (1) preferably includes two primary locking elements (20) and one secondary locking element (30).

17. The locking mechanism (1) according to claim 1, characterized in that the base body (10) of the locking mechanism (1) is formed integrally with the plug-in connector (40).

18. The locking mechanism (1) according to claim 1, characterised in that the base body (10) of the locking mechanism (1) can be releasably connected to the plug-in connector (40).

19. The locking mechanism (1) according to claim 1, characterised in that the primary spring element (25) is implemented as an annular spring and comprises the base body (10).

20. The locking mechanism (1) according to claim 1, characterised in that a spring element (35) is provided which exerts a force on the secondary locking element (30) and in this way effects a forced movement of the secondary locking element (30) into the second position (3B).

21. The locking mechanism (1) according to claim 20, characterised in that the spring element (35) is implemented as a coil spring and is clamped between the secondary locking element (30) and the base body (10).

* * * * *